US009049918B2

(12) United States Patent
Perelli et al.

(10) Patent No.: US 9,049,918 B2
(45) Date of Patent: Jun. 9, 2015

(54) FOLDING BROOM

(75) Inventors: Thomas Perelli, Winchester, VA (US); Grant Mason, Stephens City, VA (US); Matthew Scott Kepner, Stephens City, VA (US); James Lloyd Drake, II, Stephens City, VA (US)

(73) Assignee: Rubbermaid Commercial Products, LLC, Winchester, VA (US)

( * ) Notice: Subject to any disclaimer, the term of this patent is extended or adjusted under 35 U.S.C. 154(b) by 332 days.

(21) Appl. No.: 13/089,868

(22) Filed: Apr. 19, 2011

(65) Prior Publication Data

US 2011/0252591 A1 Oct. 20, 2011

Related U.S. Application Data

(60) Provisional application No. 61/325,636, filed on Apr. 19, 2010.

(51) Int. Cl.

| | |
|---|---|
| ***A46B 7/00*** | (2006.01) |
| ***A46B 7/02*** | (2006.01) |
| ***A46B 15/00*** | (2006.01) |
| ***A46B 5/00*** | (2006.01) |

(52) U.S. Cl.

CPC ..... *A46B 5/0033* (2013.01); *Y10T 403/32368* (2015.01); *Y10T 403/32361* (2013.01); *Y10T 16/50* (2015.01); *Y10T 403/32344* (2015.01); *Y10T 403/32336* (2015.01); *Y10T 403/32327* (2015.01); *A46B 5/005* (2013.01); *A46B 7/023* (2013.01); *A46B 2200/302* (2013.01)

(58) Field of Classification Search

USPC ..... 15/203, 171, 159.1; 134/6

See application file for complete search history.

(56) References Cited

U.S. PATENT DOCUMENTS

| | | | | |
|---|---|---|---|---|
| 2,801,433 | A * | 8/1957 | Palma, Jr. et al. | 15/119.2 |
| 4,054,313 | A * | 10/1977 | Ciuci | 294/53.5 |
| 4,908,900 | A * | 3/1990 | McLaughlin et al. | 15/111 |
| 6,088,868 | A * | 7/2000 | Cerveny | 15/144.3 |
| 6,925,686 | B2 * | 8/2005 | Heathcock et al. | 16/429 |
| 7,178,190 | B2 * | 2/2007 | Jones et al. | 15/172 |
| 7,343,637 | B2 * | 3/2008 | Lafleur | 15/111 |
| 2001/0044980 | A1 * | 11/2001 | Duplessis | 15/121 |
| 2011/0114118 | A1 * | 5/2011 | Gracindo et al. | 134/6 |

OTHER PUBLICATIONS

Perelli, Thomas, et al., United States Patent and Trademark Office, U.S. Appl. No. 13/089,871, filed Apr. 19, 2011.

* cited by examiner

*Primary Examiner* — Monica Carter
*Assistant Examiner* — Stephanie Berry
(74) *Attorney, Agent, or Firm* — Dennis J. Williamson; Moore & Van Allen PLLC

(57) ABSTRACT

A broom comprises a handle and a head supported by the handle. The head comprises a first head section pivotably connected to a second head section such that the head sections may rotate relative to one another between a folded position and an unfolded position. An actuator is movably mounted on the handle between a first position and a second position. A first connecting member connects the actuator to the first head section and a second connecting member connects the actuator to the second head section such that movement of the actuator between the first position and the second position moves the head sections relative to one another between the folded position and the unfolded position. A method of operating the broom is also provided.

25 Claims, 5 Drawing Sheets

FOLDING BROOM

This application claims benefit of priority under 35 U.S.C. §119(e) to the filing date of to U.S. Provisional Application No. 61/325,636, as filed on Apr. 19, 2010, which is incorporated herein by reference in its entirety.

BACKGROUND

A conventional push broom typically comprises a handle fixed in position to the brush head such as by a screwthread connection. The brush head typically has an array of relatively coarse, stiff bristles extending from the bottom of the head such that a user may grasp the handle to push or pull the broom across a floor or other surface. The handle is typically centered on and fixed at a 90 degree angle relative to the long axis of the brush head. As a result, the typical conventional broom is difficult to store efficiently especially in small areas such as janitorial closets. The conventional push broom crowds and inhibits access to other tools when stored on the floor, in a barrel, or hung on the wall of a janitorial closet. The same problem occurs when transporting conventional brooms in tradesman vans and trailers.

SUMMARY OF THE INVENTION

A broom comprises a handle and a head supported by the handle. The head comprises a first head section pivotably connected to a second head section such that the head sections may rotate relative to one another between a folded position and an unfolded position. An actuator is movably mounted on the handle between a first position and a second position. A first connecting member connects the actuator to the first head section and a second connecting member connects the actuator to the second head section such that movement of the actuator between the first position and the second position moves the head sections relative to one another between the folded position and the unfolded position.

In the unfolded position the first head section and the second head section may be positioned at 90 degrees relative to the handle and in-line with one another, and in the folded position the head sections may be positioned parallel to one another and to the handle. The first head section and the second head section may be rotated approximately 90 degrees between the folded and the unfolded positions. The handle may be collapsible and may comprise a first section that is telescopically received in a second section to allow relative movement therebetween. A twist locking collar may be used to lock the first section relative to the second section. The first head section and the second head section may be of equal length. The first head section and the second head section may comprise bristles. The first head section may be pivoted to the second head section at a pivot joint where the pivot joint comprises a first aperture on the first head section and a second aperture on the second head section where the first and second apertures receive a pivot pin such that the first head section may pivot relative to the second head section about the pivot pin. The first head section and the second head section may comprise mating faces that abut one another when the first head section and the second head section are in the unfolded position. The first connecting member may be connected to the actuator at a first pivot joint and the second connecting member may be connected to the actuator at a second pivot joint. The first connecting member may be connected to the first head section at a third pivot joint and the second connecting member may be connected to the second head section at a fourth pivot joint. The actuator may comprise a sleeve that is disposed over the handle such that the sleeve may slide over the handle. A lock may be provided to lock the actuator in the first position and the second position. The lock may comprise an aperture provided on the actuator that receives a first pin and a second pin where the first pin is positioned on the handle such that the first pin is disposed opposite to the aperture when the actuator is in the extended position and the second pin is positioned on the handle such that the second pin is disposed opposite to the aperture when the grip is in the retracted position. The first pin and the second pin may be biased to an extended position by springs.

A method of using a broom comprises providing a handle and a head supported by the handle, the head comprising a first head section pivotably connected to a second head section such that the head sections may rotate relative to one another between a folded position and an unfolded position; an actuator movably mounted on the handle between a first position and a second position; and a first connecting member connecting the actuator to the first head section and a second connecting member connecting the actuator to the second head section; unlocking the actuator from the handle; and moving the actuator between the first position and the second position to move the head sections relative to one another between the folded position and the unfolded position. The method may further comprise collapsing or extending the handle.

DETAILED DESCRIPTION OF EMBODIMENTS OF THE INVENTION

The folding push broom comprises a handle connected to a broom head where the broom head that is divided into two sections. One end of each head section is connected to one end of the broom handle by a pivot joint. The two broom head sections can be rotated between an unfolded use position where the sections are positioned at 90 degrees relative to the handle and are in-line with one another and a folded storage position where the head sections are disposed parallel one another and to the handle. A connector member is connected between each head section and an actuator where movement of the actuator relative to the broom handle is transmitted to the head sections via the connecting members. To fold and unfold the broom head between the storage and use positions, the actuator is slid up and down the broom handle to rotate the head sections relative to one another. A lock is provided to lock the actuator in the folded and unfolded positions. The handle may be made collapsible to further reduce the size of the broom in the folded position for more efficient storage and transport. The broom may be a standard size broom when in the unfolded use position that folds for efficient storage such as on a wall, in a tool tower or in a contractor's tool box, trailer or van.

Figure 3:
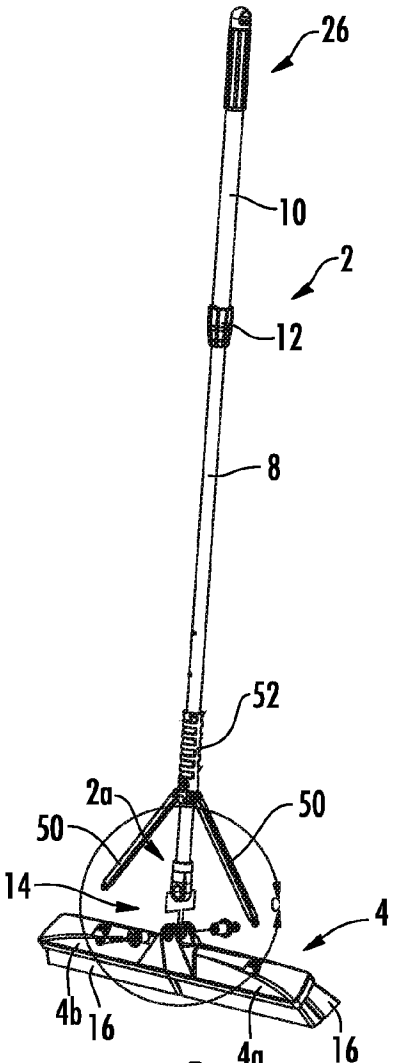
FIG. 3 is an exploded perspective view of the broom of FIG. 1 in the use position.
Figure 2:
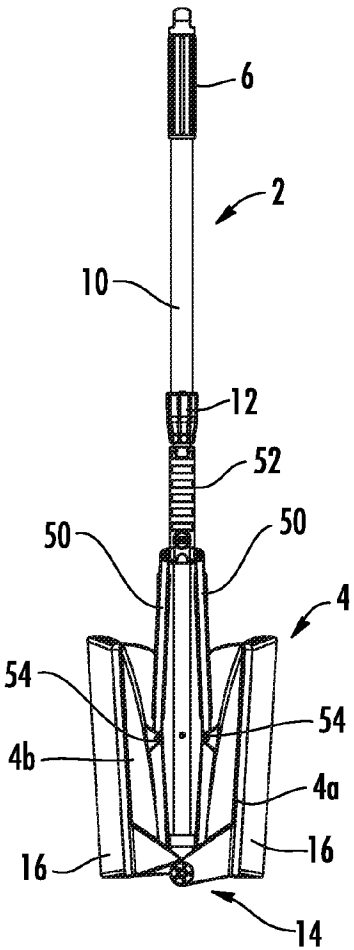
FIG. 2 is a front view of the broom of FIG. 1 in a folded, storage configuration.
Figure 1:
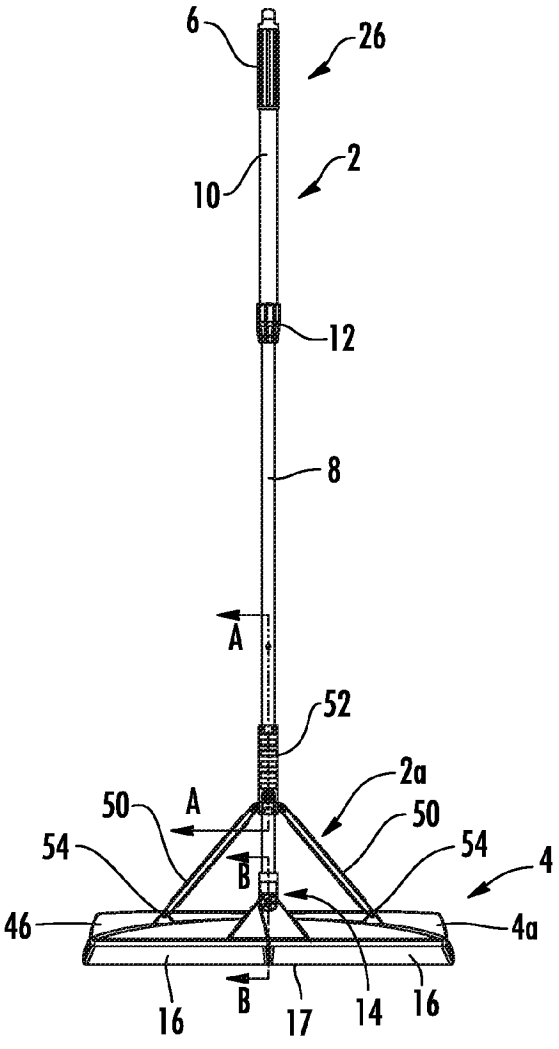
FIG. 1 is a front view of an embodiment of the broom of the invention in an unfolded, use configuration.
Figure 5:
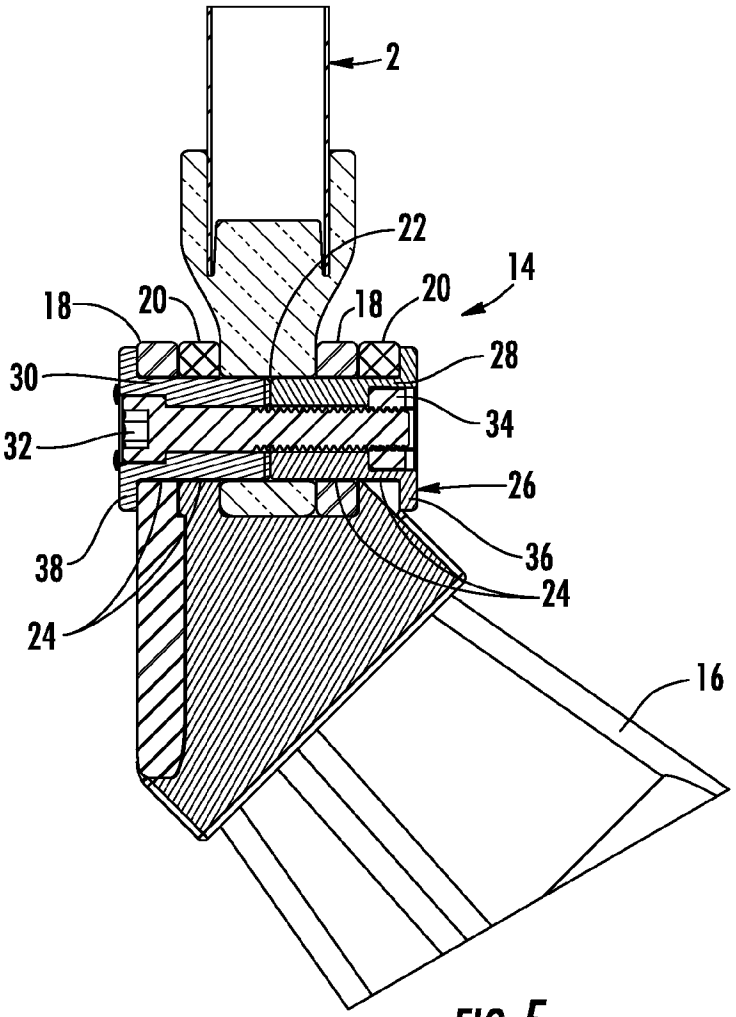
FIG. 5 is a section view taken along line B-B of FIG. 1.

In one embodiment the broom comprises a handle 2 that has a first end 2*a* that is connected to broom head 4 as will hereinafter be described and a second end 2*b* that is spaced from the first end and may be provided with a hand grip 6 that may be grasped by an end user during use of the broom. The handle 2 may be an adjustable handle as shown where a first handle section 8 is movable relative to a second handle section 10 such that the length of the handle 2 may be adjusted. The handle 2 may be adjusted between a completely extended use position shown in FIG. 1 to the completely retracted storage position shown in FIG. 2. The handle 2 may also occupy any position between these positions to accommodate the needs of the end user. The first section 8 may be telescopically received in second section 10 to allow relative movement therebetween. A twist locking collar 12 may be used to lock the first section 8 relative to the second section 10.

To provide the folding functionality of the broom head 4, the broom head 4 comprises a first head section 4*a* and a second head section 4*b* mounted for pivoting motion relative to one another at a pivot joint 14. The head sections 4*a*, 4*b* may be of equal length such that the handle 2 is located at the midpoint of the broom head 4. The head sections 4*a*, 4*b* comprise bristles 16 or a squeegee, sponge, dust pad or other cleaning device on the side opposite handle 2 that are arranged such that when the head 4 is in the use position of FIG. 1 the cleaning device constitutes a relatively uninterrupted cleaning surface 17.

Figure 6:
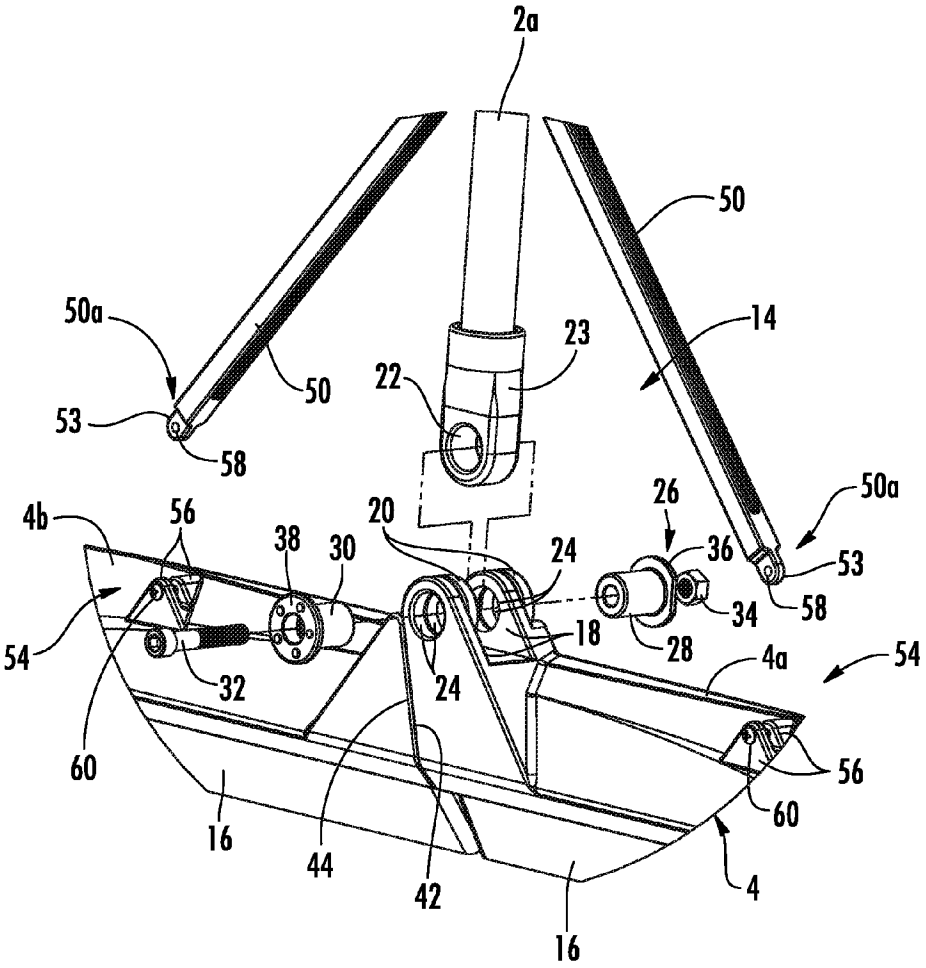
FIG. 6 is a detailed exploded view of an embodiment the pivot joint.

Referring to FIG. 6, pivot joint 14 comprise flanges 18 provided on head section 4*a* and flanges 20 provided on head section 4*b* arranged in pairs. The flanges 18 and 20 interdigitate and each of the flanges is provided with an aperture 24. The apertures 24 are aligned to receive a pivot pin 26 such that the head sections 4*a*, 4*b* may pivot relative to one another about pin 26. The end 2*a* of handle 2 comprises a yoke 23 that is dimensioned to be received between the pairs of flanges 18 and 20 and comprises an aperture 22 that also receives the pin 26 such that the head sections 4*a* and 4*b* may also pivot relative to handle 2. The head sections 4*a*, 4*b* are also provided with surfaces that but one another when the head sections reach the unfolded position to stop movement of the head sections. In the illustrated embodiment each flange 18, 20 is provided with mating faces 42 and 44 that abut one another when the head sections 4*a*, 4*b* are in the use position to stop movement of the head sections 4*a*, 4*b* when the head sections reach the aligned use position. As shown in FIG. 6, in some embodiments the mating faces meet at an acute angle from a line formed by the first and second head sections 4*a*, 4*b* in the unfolded position. In the illustrated embodiment the pivot pin 26 comprises a first headed member 28 and a second headed member 30 that are inserted through the aligned apertures 22, 24. A threaded screw 32 and nut 34 secure the members 28, 30 to one another with the flanges 16, 18 and yoke 23 trapped between heads 36 and 38. The pivot joint 14 allows the head sections 4*a*, 4b to pivot relative to one another between the use position where the head sections are in-line with one another and at a substantially right angle relative to handle 2 and the folded storage position where the head sections 4*a*, 4*b* extend along the handle 2 and are substantially parallel to one another and to the handle 2.

A rigid connecting member 50 such as a rod connects each of head sections 4*a* and 4*b* to an actuator 52 that is movably mounted on the handle adjacent end 2*a*. The connecting members 50 act as transmission members to communicate the movement of actuator 52 to the head sections 4*a*, 4*b* and as a reinforcement brace to provide gusset-like support between the head sections 4*a*, 4*b* and the handle 2 when the head sections are in the unfolded use position. One end 50*a* of each connecting member 50 is connected to each of the head sections 4*a*, 4*b* at a pivot joint 54. The pivot joint 54 may comprise a pair of flanges 56 that extend from the top surface of heads 4*a*, 4*b* and that receive an eye 50*a* of member 50. The flanges 56 and eye 53 comprise aligned apertures 58 that receive a pin 60. In the illustrated embodiment the pin 60 comprises a threaded member that threadably engages the body of head sections 4*a*, 4*b* to fix the pin 60 to the head sections. The member 50 is free to pivot around pin 60.

The opposite ends 50*b* of the members 50 are connected to the actuator 52 at pivot joints 64. The pivot joints 64 may be similarly constructed to joints 54 and comprise a pair of flanges 66 that extend from the actuator 52 and that receive an eye formed on the end 50*b* of member 50. The flanges 66 and eye comprise aligned apertures that receive a pin 70 such that the member 50 is free to pivot around pin 70. The connecting members 50 provide the folding action of the broom head 4 and are arranged at approximately a 45 degree angle relative to the handle 2 and head sections 4*a*, 4*b* to act as structural gusset members to improve broom rigidity and robustness when the broom is in the unfolded configuration.

Figure 4:
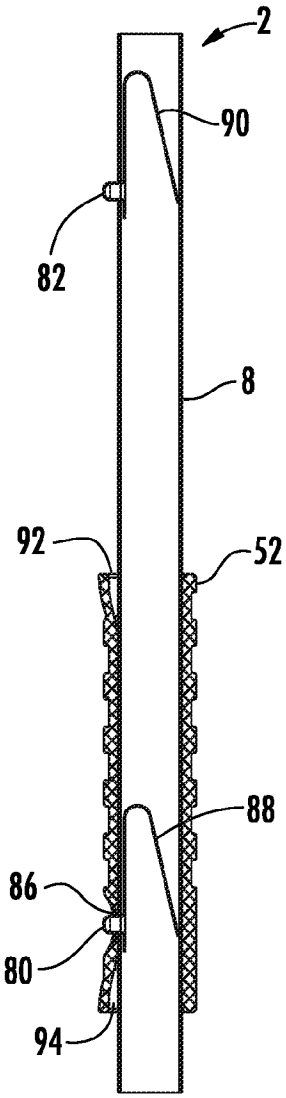
FIG. 4 is a section view taken along line A-A of FIG. 1.
Figure 8:
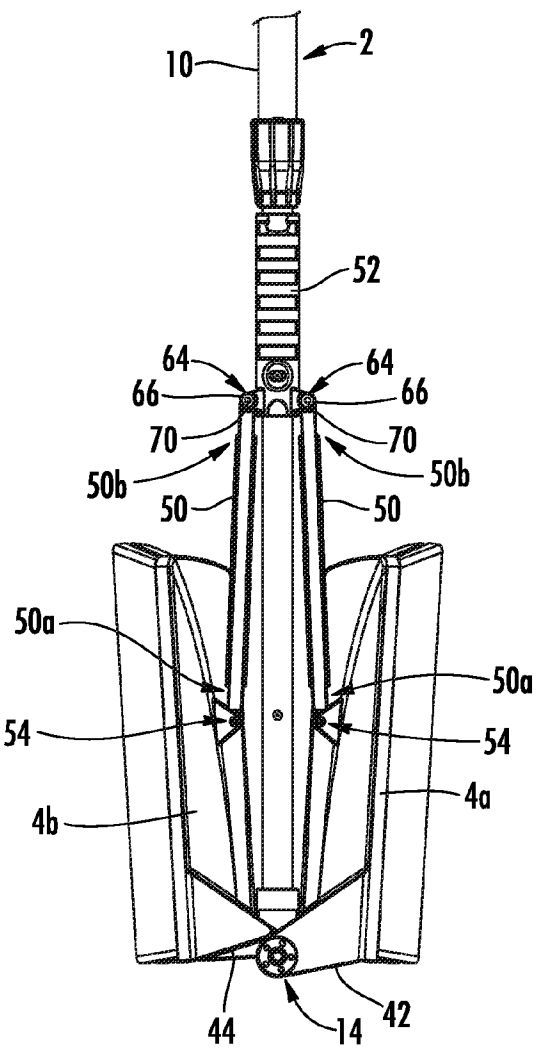
FIG. 8 is a detailed view of the broom of FIG. 1 in a folded, storage configuration.
Figure 7:
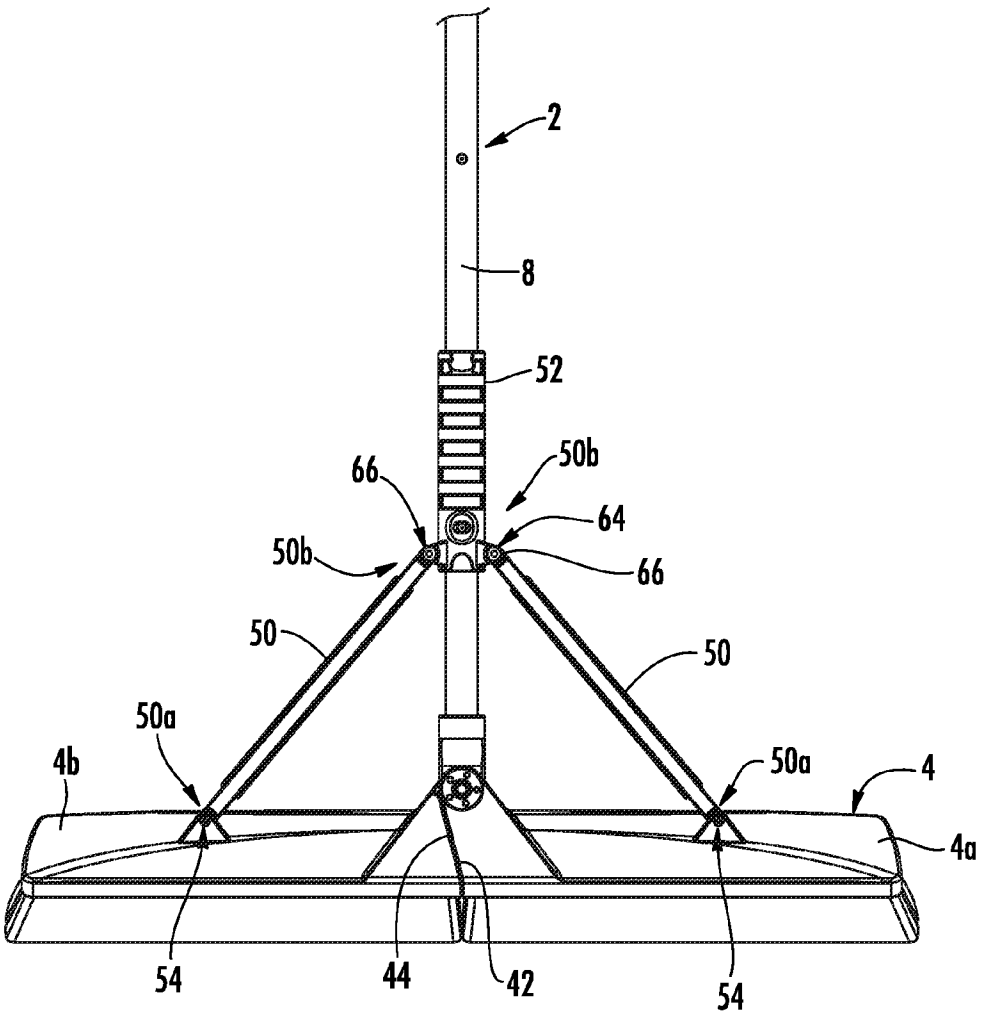
FIG. 7 is a detailed view of the broom of FIG. 1 in an unfolded, use configuration.
Figure 9:
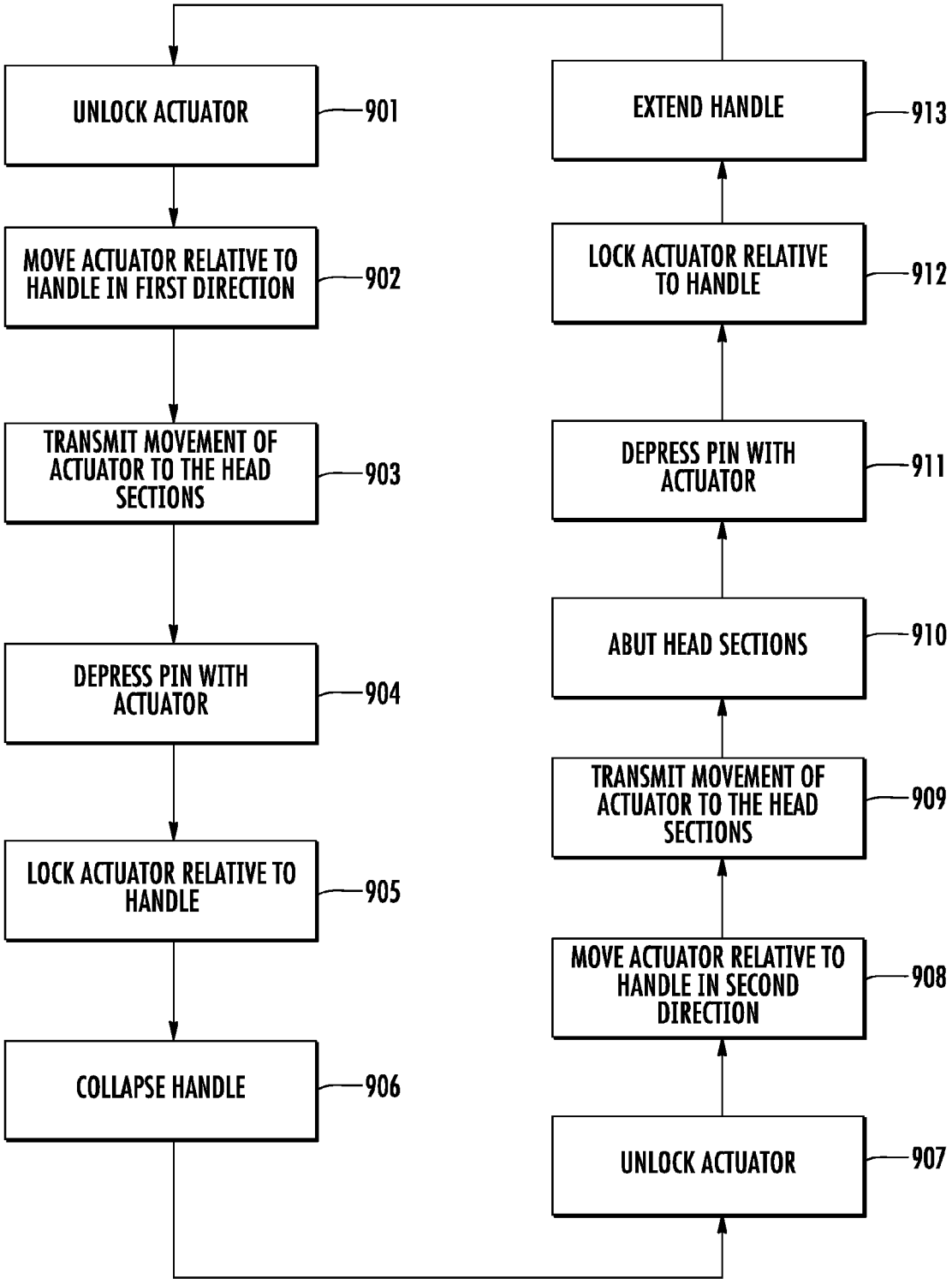
FIG. 9 is a block diagram illustrating an embodiment of a method of using the broom of the invention.

Referring to FIGS. 4, 7 and 8, the actuator 52 may comprise a cylindrical sleeve that is disposed over handle section 8 such that the actuator 52 forms a grip that may be grasped by the user and that may freely slide over the handle 2. The actuator 52 may comprise a molded plastic or rubber cylinder having an internal diameter that is slightly greater that the diameter of handle section 8. The actuator 52 may slide between an extended position (FIG. 1), where the head sections 4*qa*, 4*b* are in the unfolded use position, and a retracted position (FIG. 2), where the head sections 4*a*, 4*b* are in the folded storage position. To lock the actuator 52 in the extended and retracted positions the actuator is provided with a lock comprising an aperture 86 on actuator 52 that receives retractable locking pins 80, 82 located on handle 2. Pin 80 is positioned on the handle 2 such that the pin 80 is disposed opposite to the aperture 86 when the actuator 52 is in the extended, unfolded use position. Pin 82 is positioned on the handle 2 such that the pin 82 is disposed opposite to the aperture 86 when the actuator 52 is in the retracted, folded storage position. The pins 80 and 82 are biased to the illustrated extended positions by springs 88 and 90, respectively. In the extended position the pins 80, 82 can engage aperture 86 to lock the actuator 52 relative to the handle 2. The user may push on the pins 80, 82 against the bias force of the springs 88, 90 to retract the pins from aperture 86 and to allow the actuator 52 to move relative to the handle 2. The actuator 52 is provided with cam surfaces 92, 94 such that when the actuator is moved over pins 80, 82, respectively, the cam surfaces push the pins against the bias of the springs to the retracted position.

To use the broom of the invention, assume that the broom is in the extended use position of FIG. 7. In this position pin 80 is engaged with the aperture 86 such that the actuator 52 is locked in the extended position relative to the handle 2 and the head sections 4*a*, 4*b* are in the aligned unfolded use position. Because the actuator 52 is locked relative to the handle 2, the members 50 are also fixed in position. Because the members 50 cannot move, the head sections 4*a*, 4*b* are prevented from rotating about pin 26. To fold the broom to the storage position, the user depresses pin 80 to disengage the pin 80 from the aperture 86 in actuator 52 and unlock the actuator from the handle 2 (block 901). The user pulls the actuator 52 toward end 2*b* of handle 2 in a first direction (block 902). As the actuator 52 slides from the extended position to the retracted position, the ends 50*b* of members 50 are pulled up the length of the handle 2 which pulls the head sections 4*a*, 4*b* such that the ends 50*a* of members 50 rotate toward handle 2 and head sections 4*a*, 4*b* rotate about pivot joint 14 from the unfolded use position (FIG. 7) to the folded storage position (FIG. 8) (block 903). When the head sections 4*a*, 4*b* reach the folded position, the head sections are disposed substantially parallel to one another and to handle 2. As the actuator 52 moves to the position of FIG. 8, the actuator 52 the cam surface 92 contacts and depresses the pin 82 (block 904). The actuator 52 is moved until the pin 82 is aligned with aperture 86 at which point spring 90 biases the pin 82 to the extended position where pin 82 engages aperture 86 to lock the actuator 52 in position relative to the handle 2 and to lock the head sections 4*a*, 4*b* in the folded storage position (block 905). The handle 2 may also be collapsed by moving section 8 relative to section 10 and locking sections 8 and 10 relative to one another with locking collar 12 in the position shown in FIG. 2 (block 906).

To unfold the broom to the use position, the user depresses pin 82 to disengage the pin 82 from the aperture 86 in the actuator 52 to unlock the actuator 52 from the handle 2 (block 907). The user pushes the actuator 52 toward end 2*a* of handle 2 in a second direction opposite to the first direction (block 908). As the actuator 52 slides from the retracted position to the extended position, the ends 50*b* of members 50 are pushed down the length of the handle 2. The members 50 push the head sections 4*a*, 4*b* such that the head sections 4*a*, 4*b* rotate about pivot joint 14 from the folded position to the unfolded use position and the ends 50*a* of members 50 swing away from the handle to provide a gusset support for the head sections 4*a*, 4*b* (block 909). When the head sections reach the completely unfolded position the surfaces 40, 42 abut one another such that the head sections 4*a*, 4*b* are supported in an aligned position relative to one another and perpendicular to handle 2 (block 910). The actuator 52 slides over pin 80 such that cam surface 94 depresses the pin 80 (block 911). The actuator 52 is moved until the pin 80 is aligned with aperture 86 at which point spring 88 biases the pin 80 to the extended position where pin 80 engages aperture 86 to lock the actuator 52 in position relative to the handle 2 and to lock the head sections 4*a*, 4*b* in the unfolded use position (block 912). The handle 2 may be extended by moving section 8 relative to section 10 and locking sections 8 and 10 relative to one another with locking collar 12 in the position shown in FIG. 1 (block 913).

While embodiments of the invention are disclosed herein, various changes and modifications can be made without departing from the spirit and scope of the invention as set forth in the claims. One of ordinary skill in the art will recognize that the invention has other applications in other environments. Many embodiments are possible. The following claims are in no way intended to limit the scope of the invention to the specific embodiments described above.

The invention claimed is:

1. A broom comprising:

a handle including a first aperture defined in a yoke at a first end of the handle;

a head supported by the handle and comprising a first head section and a second head section pivotably mounted on the first end of the handle such that the first and second head sections may rotate relative to the handle between a folded position where the first and second head sections are disposed generally along the handle and an unfolded position where the first and second head sections are disposed in an aligned use position, where the first head section comprises a second aperture on a first flange of the first head section and a fourth aperture on a second flange of the first head section, where the second head section comprises a third aperture on a third flange of the second head section and a fifth aperture on a fourth flange of the second head section, where the first, second, third, fourth, and fifth apertures receive a pivot pin such that the first aperture is positioned between a pair comprising the second and third apertures and an opposing pair comprising the fourth and fifth apertures, such that the first head section and the second head section may pivot relative to one another and to the handle about the pivot pin;

an actuator movably mounted on the handle between a first position and a second position;

a first rigid connecting member extending between and pivotably connected to the actuator and to the first head section and a second rigid connecting member extending between and pivotably connected to the actuator and to the second head section such that movement of the actuator between the first position and the second position moves the first and second head sections relative to one another between the folded position and the unfolded position.

2. The broom of claim 1 further comprising a lock to lock the actuator in the first position and the second position.

3. The broom of claim 1 wherein in the unfolded position the first head section and the second head section are positioned at 90 degrees relative to the handle and are in-line with one another.

4. The broom of claim 1 wherein the first head section and the second head section are rotated approximately 90 degrees between the folded and the unfolded positions.

5. The broom of claim 1 wherein the handle comprises a first section that is telescopically received in a second section to allow relative movement between the first section and the second section between an extended position and a collapsed position.

6. The broom of claim 5 further comprising a twist locking collar to lock the first section relative to the second section.

7. The broom of claim 1 wherein the first head section and the second head section comprise bristles.

8. The broom of claim 1 wherein the actuator comprises a sleeve that is disposed over the handle such that the sleeve may slide over the handle.

9. The broom of claim 2 wherein the lock comprises an aperture on one of the handle and the actuator that receives a pin on the other one of the handle and the actuator, the pin being biased to an extended position by a spring.

10. A broom comprising:

a handle;

a head supported by the handle and comprising a first head section and a second head section pivotably mounted on a first end of the handle such that the first and second head sections may freely rotate relative to the handle between a folded position where the first and second head sections are disposed generally along the handle and an unfolded position where the first and second head sections are disposed in an aligned use position, and where the first head section, the second head section and the handle pivot relative to one another about a single pivot axis, where the first head section and the second head section comprise mating faces joined at a single pivot point that abut one another when the first head section and the second head section are in the unfolded position;

an actuator movably mounted on the handle between a first position and a second position;

a first rigid connecting member extending between and pivotably connected to the actuator and to the first head section and a second rigid connecting member extending between and pivotably connected to the actuator and to the second head section such that movement of the actuator between the first position and the second position moves the first and second head sections relative to one another between the folded position and the unfolded position.

11. The broom of claim 10 where the handle comprises a first end and a second end, the head being supported adjacent the first end and the actuator being moved toward the second end when the actuator is moved between the first position and the second position.

12. The broom of claim 10, wherein the mating faces meet at an acute angle from a line formed by the first and second head sections in the unfolded position.

13. The broom of claim 10 wherein in the unfolded position the first head section and the second head section are positioned at 90 degrees relative to the handle and are in-line with one another.

14. The broom of claim 10 wherein the first head section and the second head section are rotated approximately 90 degrees between the folded and the unfolded positions.

15. The broom of claim 10 where the handle is collapsible.

16. The broom of claim 15 wherein the handle comprises a first section that is telescopically received in a second section to allow relative movement between the first section and the second section between an extended position and a collapsed position.

17. The broom of claim 16 further comprising a twist locking collar to lock the first section relative to the second section.

18. The broom of claim 10 wherein the first head section and the second head section are of equal length.

19. The broom of claim 10 wherein the first head section and the second head section comprise bristles.

20. The broom of claim 10 wherein the first connecting member is connected to the actuator at a first pivot joint and the second connecting member is connected to the actuator at a second pivot joint.

21. The broom of claim 20 wherein the first connecting member is connected to the first head section at a third pivot joint and the second connecting member is connected to the second head section at a fourth pivot joint.

22. The broom of claim 10 wherein the actuator comprises a sleeve that is disposed over the handle such that the sleeve may slide over the handle.

23. The broom of claim 10 further comprising a lock to lock the actuator in the first position and the second position.

24. The broom of claim 23 wherein the lock comprises an aperture on one of the handle and the actuator that receives a pin on the other one of the handle and the actuator.

25. The broom of claim 24 wherein the pin is biased to an extended position by a spring.

* * * * *